US005685120A

United States Patent [19]

Sihra

[11] Patent Number: 5,685,120

[45] Date of Patent: Nov. 11, 1997

[54] BUILDING SYSTEM

[76] Inventor: Kirpal Singh Sihra, 199 Moss Lane, Pinner, Middlesex MA5 3BE, Great Britain

[21] Appl. No.: 500,954

[22] PCT Filed: Jul. 22, 1993

[86] PCT No.: PCT/GB93/01543

§ 371 Date: Aug. 8, 1995

§ 102(e) Date: Aug. 8, 1995

[87] PCT Pub. No.: WO94/18403

PCT Pub. Date: Aug. 18, 1994

[30] Foreign Application Priority Data

Feb. 10, 1995 [GB] United Kingdom ..... 9302660

[51] Int. Cl.[6] ..... F04C 1/00; F04B 2/56

[52] U.S. Cl. ..... 52/604; 52/575; 52/608; 52/609; 273/160; 273/156; 446/125

[58] Field of Search ..... 52/604, 574, 575, 52/576, DIG. 2, 608, 609, 589.1; 273/160, 156; 446/124, 125, 104, 105, 106, 114

[56] References Cited

U.S. PATENT DOCUMENTS

| | | | |
|---|---|---|---|
| 274,357 | 3/1883 | McKenna | 52/DIG. 2 X |
| 1,040,190 | 10/1912 | Haas | 273/160 |
| 1,455,009 | 5/1923 | Schenk | 273/160 |
| 2,432,031 | 12/1947 | Morris | 273/160 |
| 2,473,369 | 6/1949 | Harris | 273/160 |
| 3,949,994 | 4/1976 | Knarr | 273/160 |
| 4,676,507 | 6/1987 | Patterson | 273/160 |
| 4,880,238 | 11/1989 | Derouin | 273/160 |

FOREIGN PATENT DOCUMENTS

| | | | |
|---|---|---|---|
| 0835940 | 4/1952 | Germany | 52/608 |
| 1725937 | 4/1992 | Russian Federation | 273/160 |
| 0663543 | 12/1987 | Switzerland . | |
| 1048841 | 11/1966 | United Kingdom | 273/160 |
| 9004688 | 5/1990 | WIPO . | |

*Primary Examiner*—Carl D. Friedman
*Assistant Examiner*—Winnie Yip
*Attorney, Agent, or Firm*—Charles D. Gunter, Jr.

[57] ABSTRACT

A building system has interlocking frame members which interengage to form a rectilinear frame. To prevent the interengaged frame members from disengaging, a lock element is associated with a joint between frame members. This lock element is a rotary lock with a trilobal locking surface. Additional locking capability can be provided by a lock ring or collar which surrounds a joint between two frame members and prevents unintentional disengagement.

7 Claims, 9 Drawing Sheets

BUILDING SYSTEM

FIELD OF THE INVENTION

This invention relates to a building system and in particular to a kit or a set of building components which can be arranged in a variety of ways in order to create structures of various forms or configurations.

DESCRIPTION OF THE PRIOR ART

In particular the invention is concerned with interlocking building components of the type described, for example, in patent specification WO90/04688, the contents of which are incorporated herein by reference. The building system described in WO90/04688 comprises interlocking building components which are shaped so that they fit together and are locked in place without the need for mortar or fixing elements such as bolts or the like.

It is a characteristic of such systems that they make use of a key element which is locked in place during construction and which holds the components together.

SUMMARY OF THE INVENTION

According to the present invention, there is provided a building member having two opposite end regions connected by a neck, wherein the neck has a cross-section which is trilobal.

The trilobal cross-section is preferably a regular triangle with convex sides. The degree of convexity of the convex side is preferably such that if one corner of the neck is placed at the apex of an imaginary right angle, then the adjacent sides of the triangle form tangents to the lines defining that right angle.

The two opposite end regions provide shoulders at either end of the neck and may be of rectilinear form. However they are not restricted to being of such form.

The building system can also included a key element for locking the system, the element comprising a wall surrounding an opening, the wall including a pair of depending shoulders which extend downwards on opposite sides of the opening by a distance greater than the downward extent of the wall sections between the shoulders.

The key element is preferably rectilinear in form, with the aperture being rectangular. The shoulders extend along two opposite sides of the aperture and the wall sections between the shoulders extend along the other two sides of the opening.

The key element locks two or more interlocked building members together by being lowered over a vertical member until it reaches the position where further downward progress is impeded by encountering a transverse member interlocked with the vertical member. In this position, the shoulders extend below the top face of the transverse member and prevent disengagement of the interlocking between the members, other than by lifting the element.

The key element may be made in two pieces, so that it can be put into position from either side of the vertical member. The shoulders may be interrupted along their length to allow transverse members to extend from the vertical member along orthogonal axes.

References here to 'vertical' and 'horizontal' refer to the expected orientation of the building system members in use. It is however possible for the locking element to be placed over an elongate member which is not truly vertical or which is even horizontal, but the essential elements of the invention will still be present.

According to a second aspect of the invention, there is provided a set of building components for assembling a building wall structure, the set comprising a plurality of horizontal elongate frame members, a plurality of vertical elongate frame members, which members can be interlocked, with the members crossing one another, to form a rectilinear frame, a plurality of lock members each having two opposite end regions connected by a neck which has a trilobal cross-section, which lock members can be fitted at the places where a vertical member crosses a horizontal member to lock the members together, and a plurality of filler members which can be engaged with one of the horizontal or vertical members to locate in the rectilinear frame, to fill the space within the frame and thus to form a continuous wall structure.

By using a lock member which has a trilobal cross-section, the advantage is obtained that the member can be rotated with the lock member shoulders rotating adjacent a neighbouring surface, without interfering with the surface. If the trilobal cross-section is a regular triangle, with convex sides, the end position of the lock piece, after twisting, is clearly recognisable, by feel, when one apex of the cross-section locates in a right angle formed between two adjacent blocks. This "location" also prevents the block from unintentional movement after it has been brought into its locking movement.

BRIEF DESCRIPTION OF THE DRAWINGS

The invention will now be further described, by way of example, with reference to the accompanying drawings, in which.

DESCRIPTION OF THE PREFERRED EMBODIMENTS

FIGS. 1–5 show three building blocks 10, 12 and 14. All three blocks have cubic end sections 16 joined by a neck. The neck shape of the blocks 10 and 14 are the same, whereas the neck shape of the block 12, which is a locking member, is different.

Figure 3:
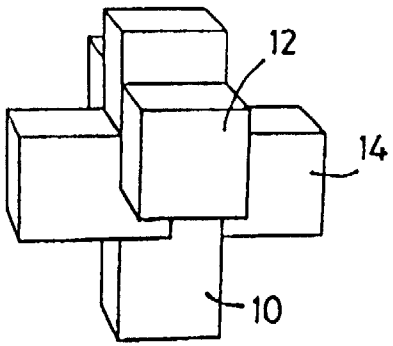
FIGS. 1–5 show sequential steps in the construction of a three-block structure built in accordance with the invention.
Figure 4:
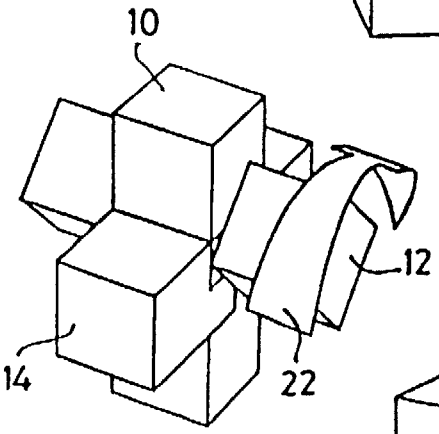
Figure 5:
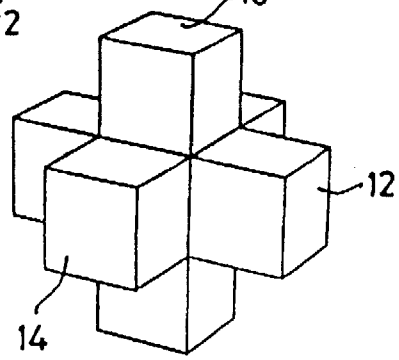
Figure 1:
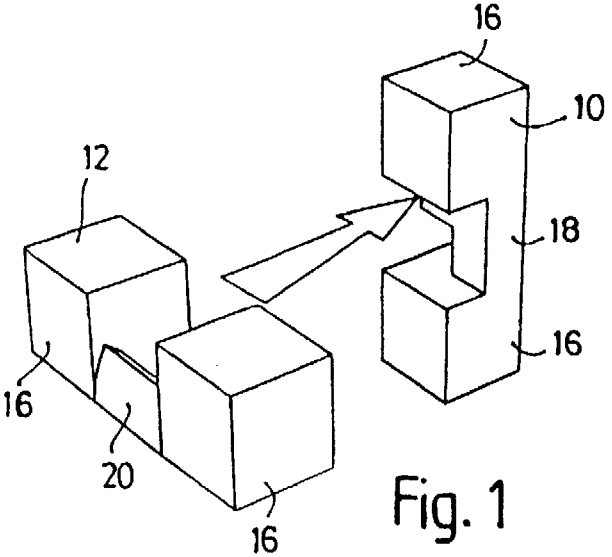
Figure 2:
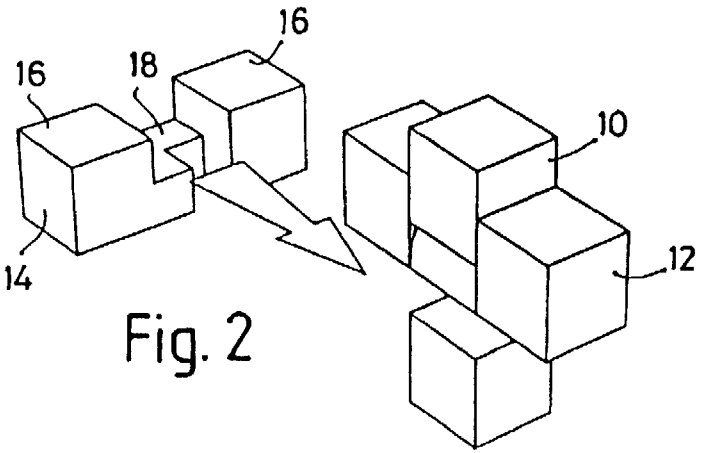

The blocks are assembled as shown in FIGS. 1–5. Firstly the neck 20 of the block 12 is fitted into the upper half of the neck 18 of the block 10. Next the block 14 is introduced from the side, so that the neck 18 of that block also fits into the neck 18 of the block 10. The assembly at this point appears as shown in FIG. 3. To lock this assembly the block 12 is rotated as indicated by an arrow 22 to produce and to lock a cruciform assembly of blocks as shown in FIG. 5.

Figure 6:
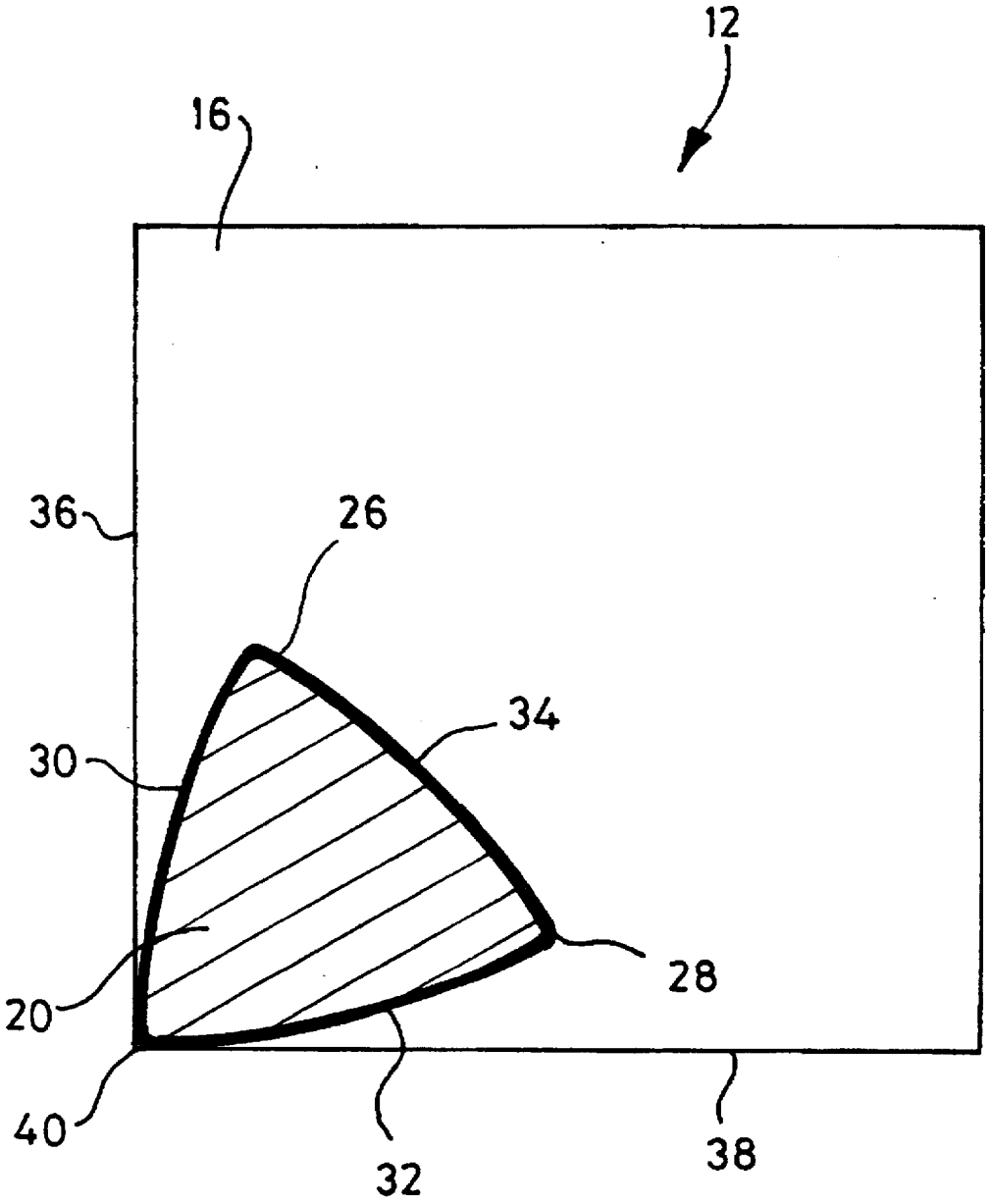
FIG. 6 is a cross-section through a lock member in accordance with the invention, on a larger scale.

The locking block 12 is shown in cross-section in FIG. 6, on a larger scale and it will be seen that the neck 20 has a generally triangular shape, with one apex of the triangle coincident with one corner of the cubic body 16. If the visible face of the cubic end section 16 is divided into four equal squares, then the other apices 26, 28 will fall on lines defining the four equal areas. The contour of the sides 30 joining the apices is not critical, but if the sides are convex as shown, with the sides 30, 32 forming tangents to the faces 36, 38 at the corner 40 then a particularly smooth action is obtained when the locking block 12 is rotated as indicated by the arrow 22.

The use of a triangular neck 20 means that the centre of rotation of the block 12 moves relative to adjacent blocks as rotation takes place. This is of particular advantage when a locking block 12 is used in a larger assembly (for example one of the assemblies shown in specification WO90/04688).

Figure 7:
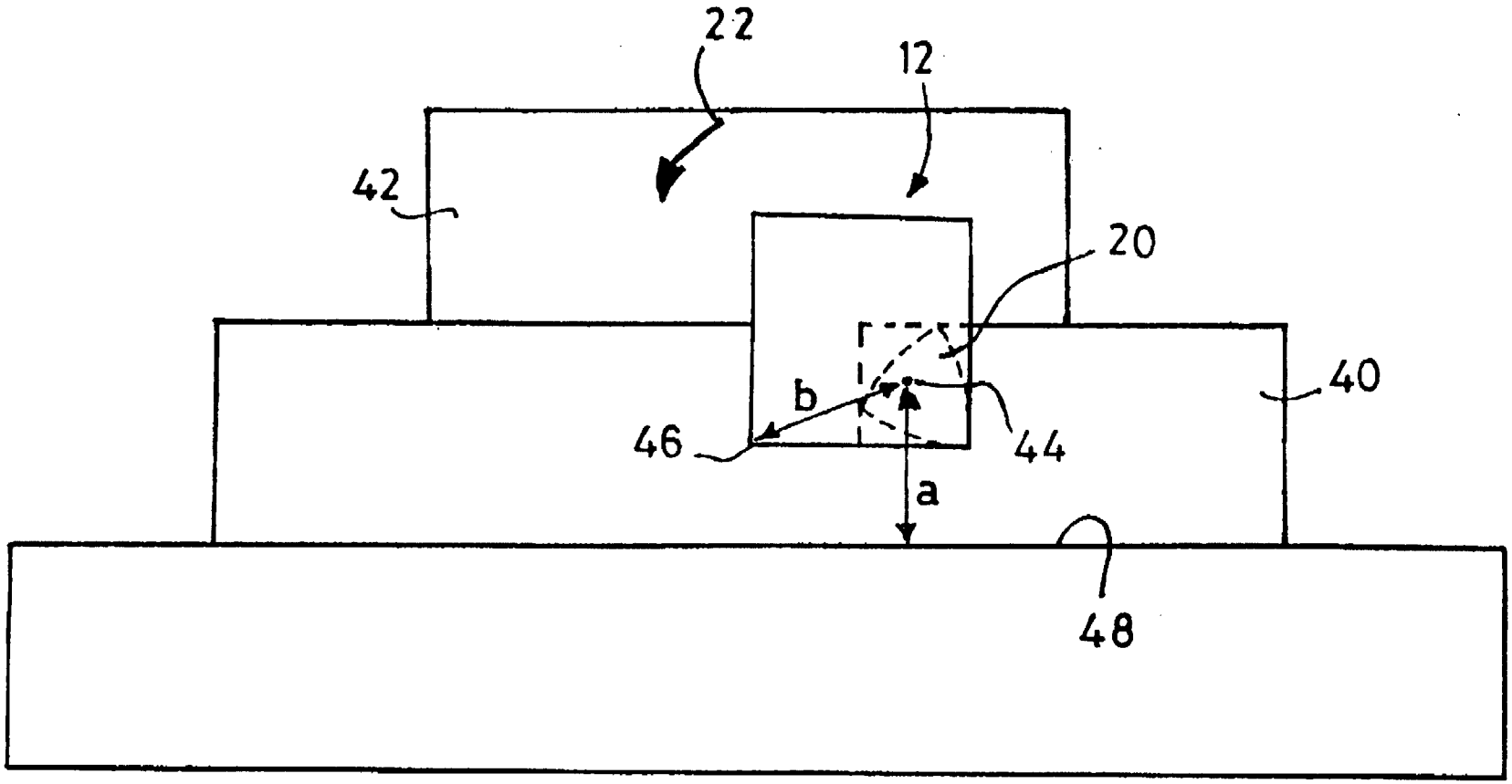
FIG. 7 illustrates the movement required of the locking members.

In FIG. 7 a locking block 12 is shown with its neck received in a recess bounded on three sides by walls of a block 40 and on a fourth side by a surface of a block 42. A dot 44 indicates the centre of the space in which the neck is received. For the block 12 to complete 90° of rotation in the direction indicated by the arrow 22, it is necessary for the corner 46 of the block to pass the surface 48. This can only be achieved if the distance 'b' is equal to or less than the distance 'a'. A study of the geometry of the blocks will show that this is not in fact the case. When the centre of rotation 44 is in the centre of the space bounded by the blocks 40 and 42, then the distance 'b' is greater than the distance 'a', and the block 12 cannot rotate to the desired-position.

However by using a triangular neck 20, the centre of rotation 44 does not stay in one place as rotation continues. The locus of the centre of rotation will actually be along a complex path surrounding the point 44. The distance of this path from the surface 48 will be greater than the distance 'b'. At the same time however all three apices of the neck 20 will remain in contact with the walls of the recess so that the locking block 12 will be positively located in the recess.

Rotation of the locking block 12 can be carried out manually in the smallest structures, or by machine in larger structures. Furthermore, the rotation can be triggered remotely where necessary, for example in undersea structures.

Various structures can be built in accordance with the invention, with various shapes of blocks, with the assembly of blocks being completed in each case by a locking block 12. The final stages of assembly of a full structure require a block arrangement based on that shown in FIGS. 1 to 7 to lock the assembled structure in position. Some of the different structures which can be achieved will be described with reference to FIGS. 8–24.

Figure 8:
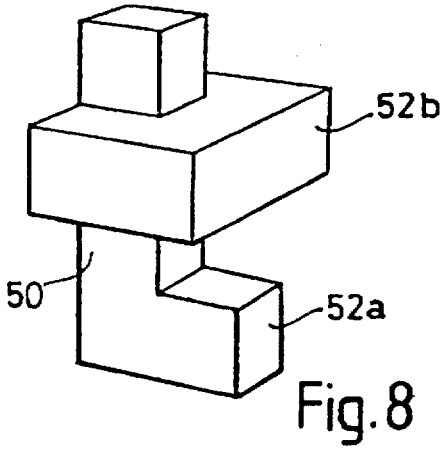
FIGS. 8 to 19 are perspective views of various different building blocks for use in a structure in accordance with the invention.
Figure 9:
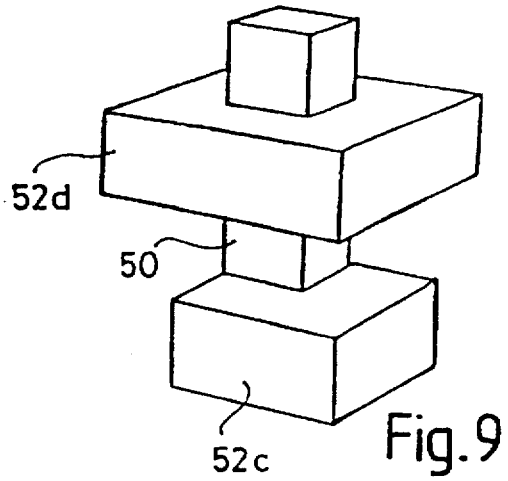

FIGS. 8 and 9 show a short, vertical support 50 with horizontal shoulders 52*a, b, c, d*. The shoulders 52*a, b, c, d* can take a number of different forms. In FIG. 8 a shoulder 52*a* extends from one face only of the generally rectangular support 50; the shoulder 52*b* extends from three faces of the support; the shoulder 52*c* extends from two faces and the shoulder 52*d* extends from four faces. The vertical support 50 can be of any length and can have any number and any combination of shoulders 52*a, b, c, d* mounted along its length. The spacing between the shoulders will generally be equal to or a multiple of the vertical dimension of the shoulders 52*a, b, c, d*.

Figure 10:
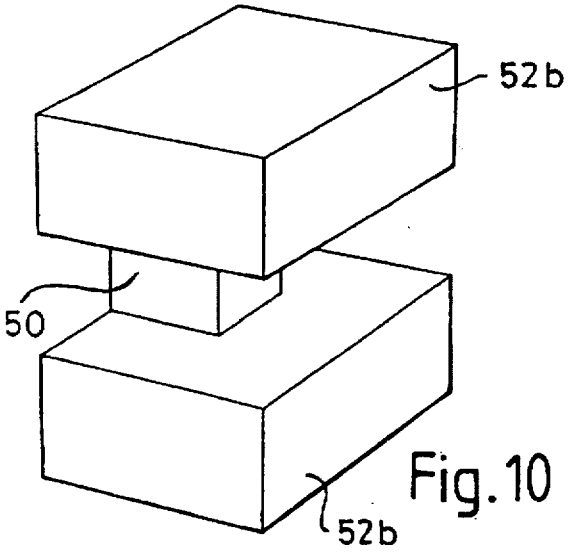

FIG. 10 shows a block with two shoulders 52*b*. This block has flush ends.

Figure 17:
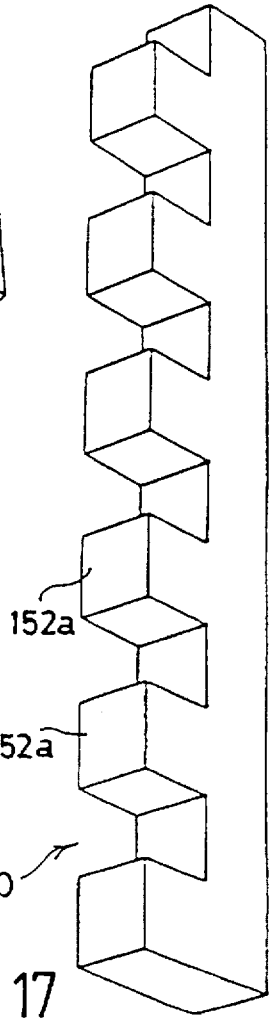

It is blocks of the type shown in FIGS. 8, 9 and 10 (and similar blocks which are vertically extended) which form the vertical skeleton of a structure. An example of a vertically extended block 150 is shown in FIG. 17 with shoulders 152*a*.

Figure 16:
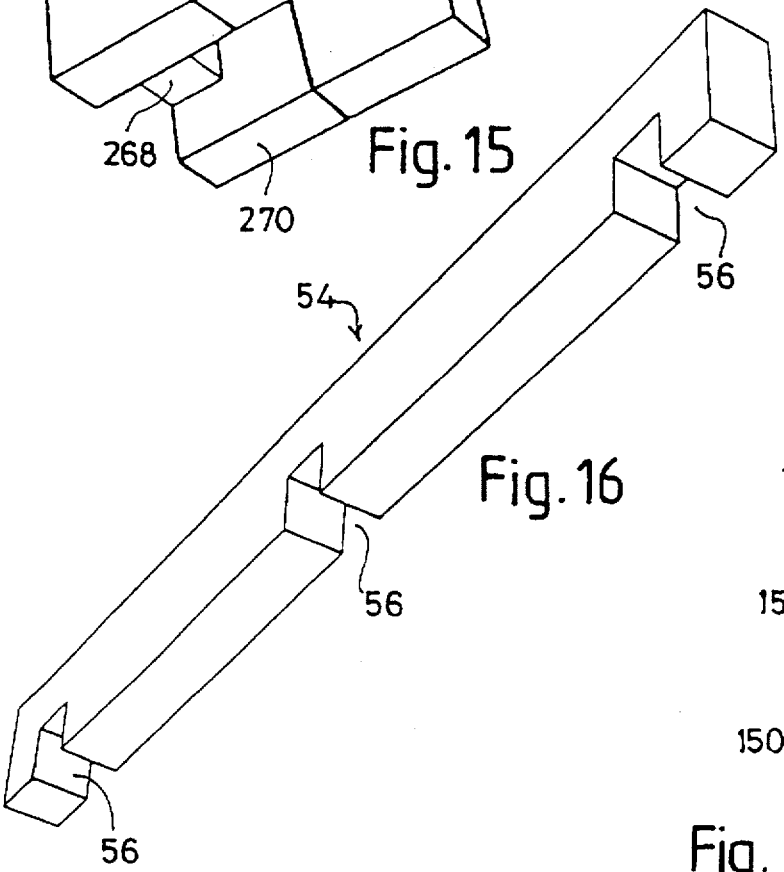

The vertical building blocks are interconnected by horizontal formers, one of which 54 is shown in FIG. 16. However a block 150 shown in the vertical orientation in FIG. 17 can also be used in the horizontal orientation to interconnect vertical blocks. It will be apparent that the recesses 56, 156 will engage around the vertical support 50, in a manner which will become apparent from the assembly drawings of FIGS. 20–24.

Figure 11:
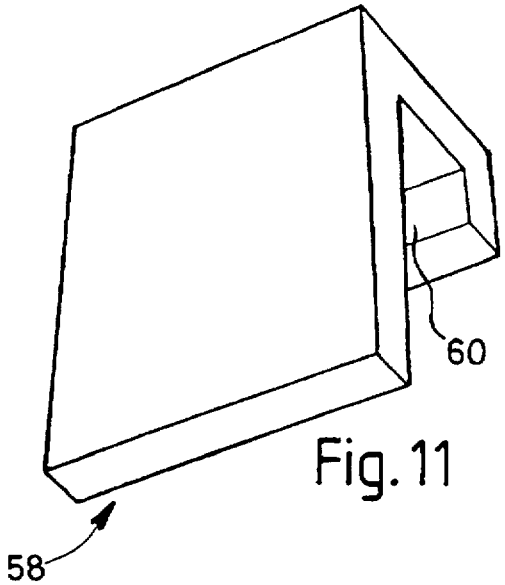
Figure 12:
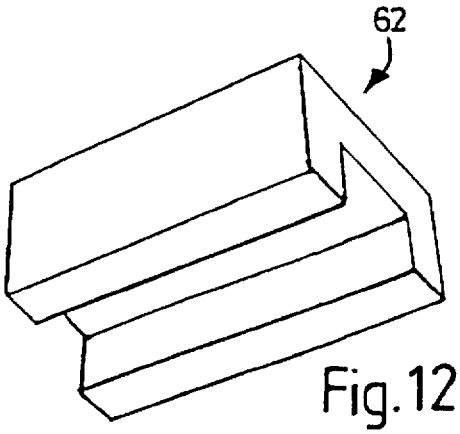

In order to close the interstices formed in a skeleton of vertical and horizontal blocks, wall blocks are used and two different wall blocks are shown in FIGS. 11 and 12. The block 58 of FIG. 11 is designed to rest upon and to be supported by horizontal blocks such as the block 54. These blocks have a hooked edge at 60 for resting on the horizontal block.

An alternative wall block is shown at 62 in FIG. 12. This block is a tongue and groove type of block which engages over or around horizontal blocks to close off the interstices between the horizontal and vertical blocks.

Figure 13:
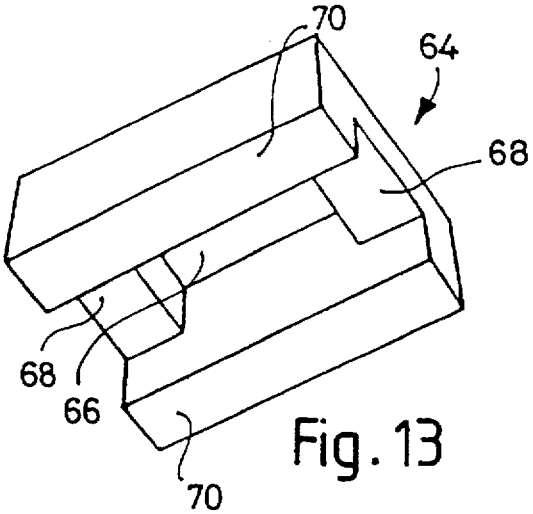
Figure 14:
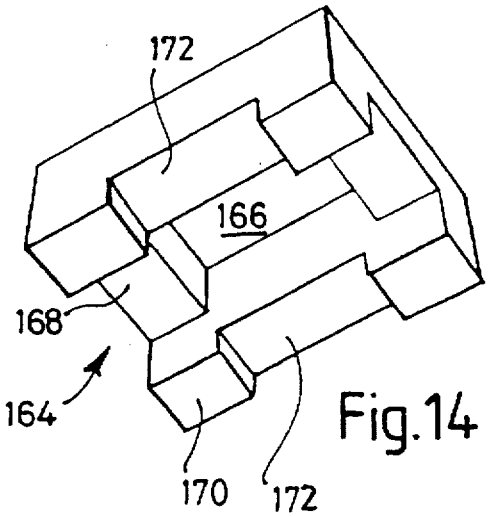
Figure 15:
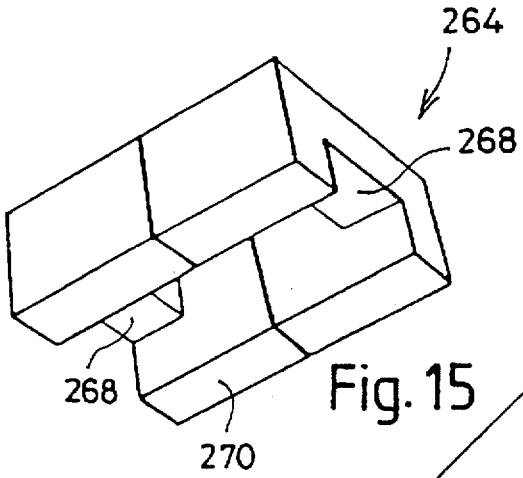

Ring locks as shown in FIGS. 13, 14 and 15 can be used to secure components together. The basic ring lock 64 shown in FIG. 13 has a central aperture 66, the size of which is slightly larger than that of the shoulder 52*b*. The ring lock 64 can therefore be lowered over a vertical member with shoulders 52*b* until the support faces 68 rest on a horizontal block. This type of block arrangement can be seen particularly in FIGS. 23 and 24 and will be described later. The side flanges 70 of the block then prevent lateral movement between a horizontal and vertical block.

The block 164 shown in FIG. 14 is similar to the block 64 but has additional cut outs at 172 to lock onto cross beams.

The ring lock 264 shown in FIG. 15 is the same shape as the lock 64 shown in FIG. 13, but is made in two parts so that it can be applied from either side of a vertical block, rather than being dropped over the top of the block.

Figure 18:
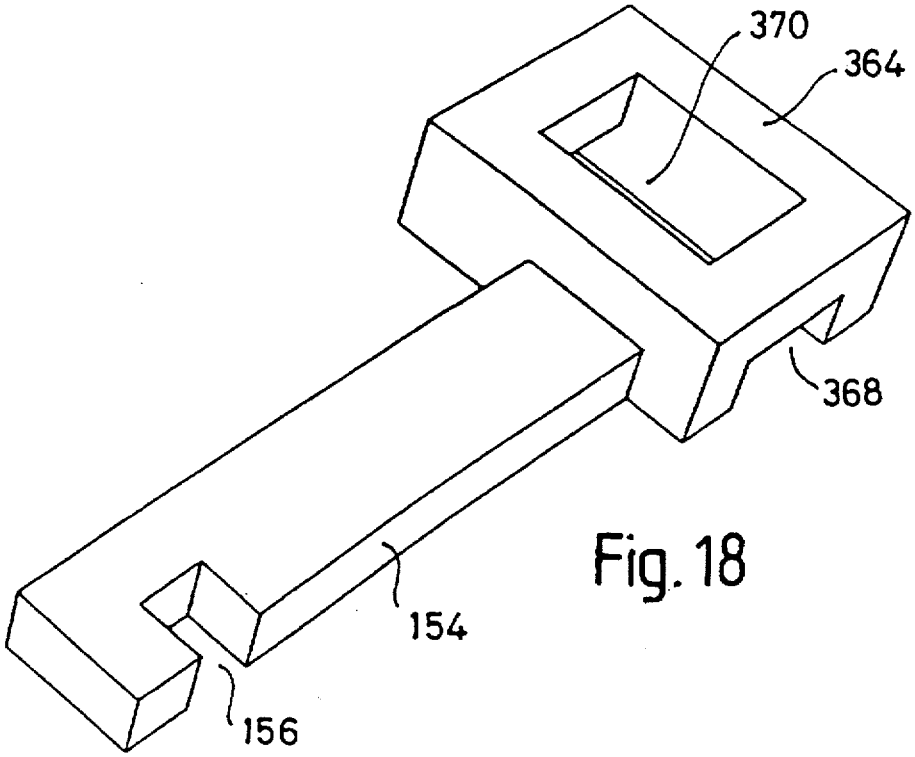
Figure 19:
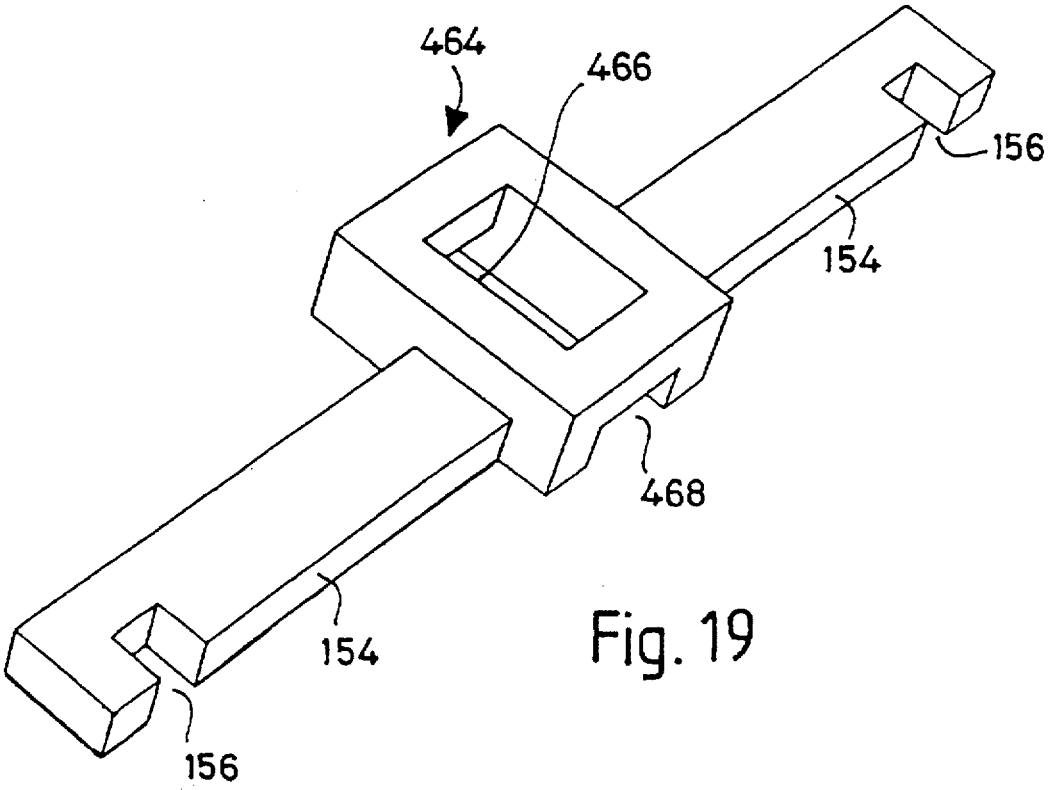

FIGS. 18 and 19 show two combination blocks where a ring lock section 364 is permanently connected to a horizontal block 154. The ring lock has one side (the side facing outwards in the drawing) which has a recess 372 corresponding to the recess 172 of FIG. 14. In this recess the end of the horizontal block 154 is permanently mounted. On the other side the ring lock 364 has a plain shoulder 370. The horizontal block section 154 has an end recess 156 corresponding to the recesses 56 of the block shown in FIG. 16.

FIG. 19 shows a development of the block shown in FIG. 18, where the ring lock 464 now has horizontal block sections 154 extending from both sides.

Figure 20:
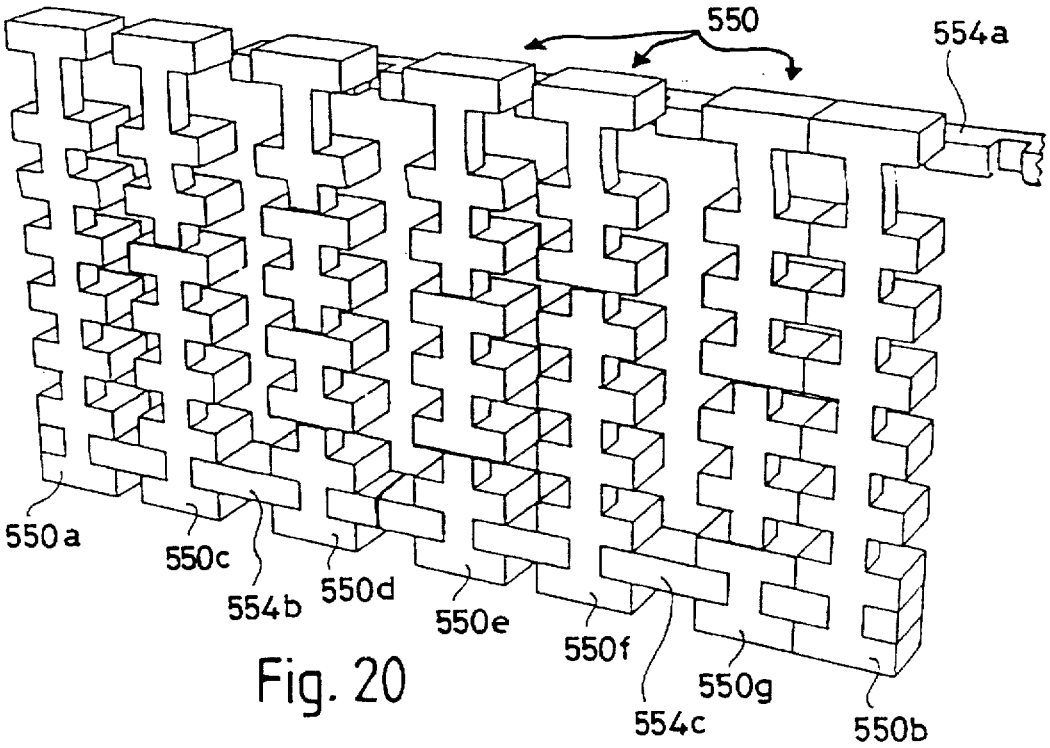
FIGS. 20 to 24 are examples of structures built in accordance with the invention.

In use, an array of vertical blocks 550 is arranged side by side as shown in FIG. 20. The blocks can each be the full height of the assembly as shown at 550*a* and 550*b*, or they can be made up from two or more smaller height blocks as shown in the support columns 550*c*, 550*d*, 550*e*, 550*f* and 550*g*. In this example the blocks all have eight shoulders of the type shown at 52*b* in FIG. 8.

The blocks 550, and indeed all the building members which form part of the building system of the invention, can be made in solid form or can be hollow. It is possible for hollow blocks to be collapsed to a flat form for transport and storage but to be opened out and erected to their three-dimensional form for use. When built into a building structure, these unfolded blocks will be retained in their erected position by the surrounding blocks.

The blocks are connected to one another by horizontal block 554. It will be seen that the upper block 554*a* is continuous over the full width of the array whilst the lower horizontal block consists of two sections 554*b* and 554*c*. The fact that the lower horizontal beam is discontinuous does not matter, provided that the discontinuity is bridged by a continuous section of the other horizontal block or blocks.

Figure 21:
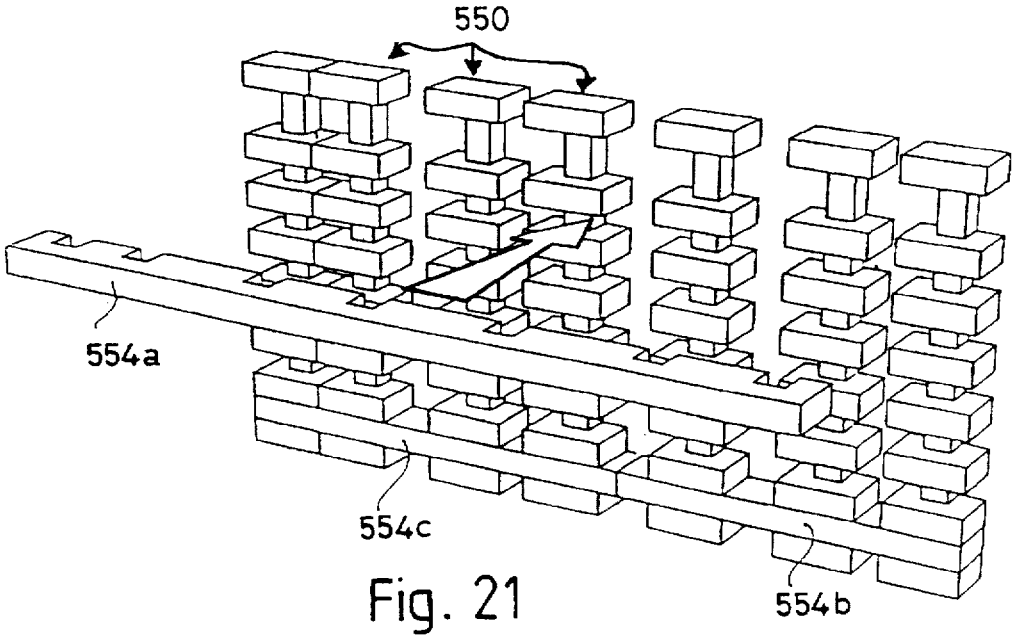

FIG. 21 shows how the horizontal and vertical members inter-engage.

Figure 22:
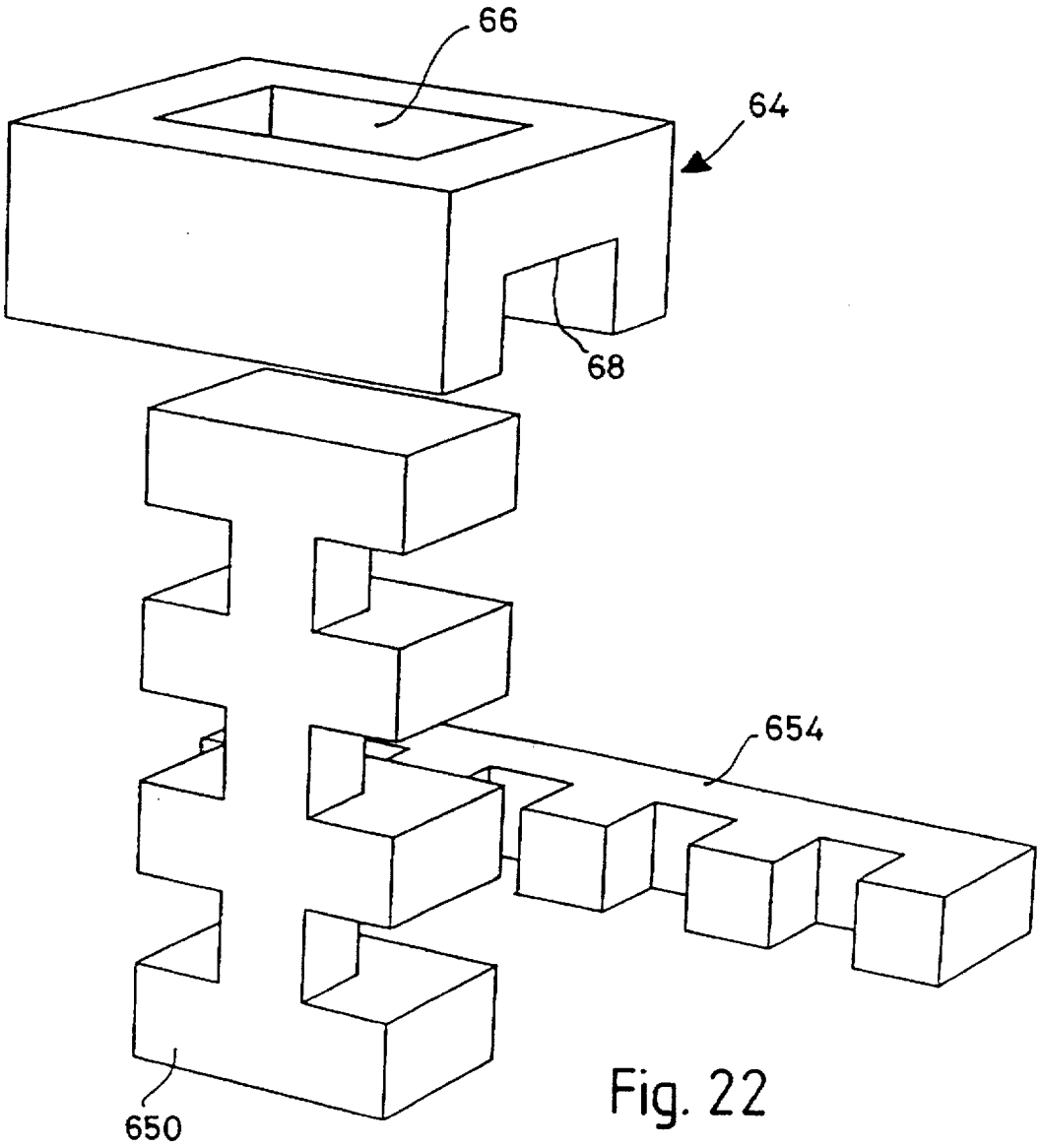

When the members are inter-engaged in this way they are interlocked, however they can still be disengaged by a sideways movement of either a vertical or horizontal block. To avoid this happening the blocks can be locked by a ring lock 64, as shown in FIG. 22. The horizontal block 654 is offered up laterally to the vertical block 650 so that inter-engagement takes place in the manner shown in FIGS. 20 and 21. To retain engagement, the ring lock 64 is dropped over the top of the vertical block 650, and drops down until the support surfaces of the ring lock rest on the upper surface of the horizontal block 654. At this point the side shoulders 70 of the ring lock prevent disengagement of the vertical blocks, and disengagement can only take place after the ring lock 64 is lifted again.

Figure 23:
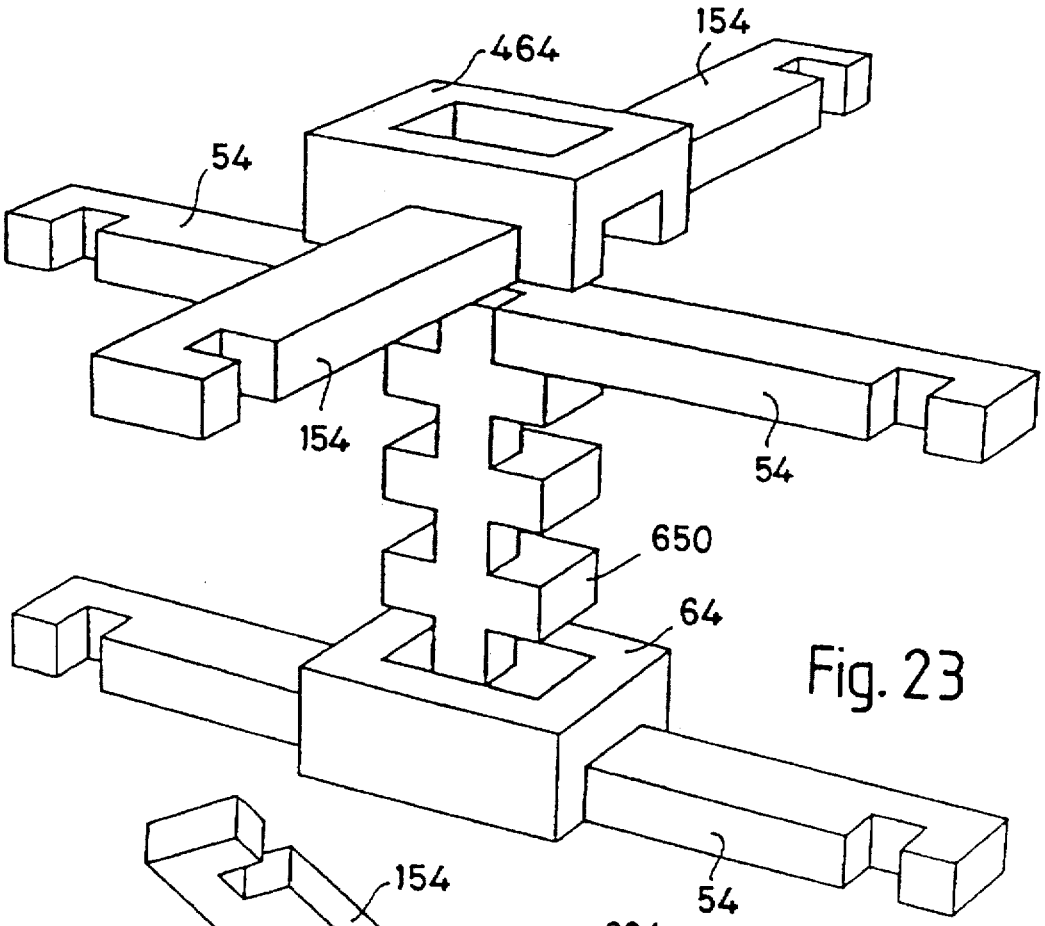
Figure 24:
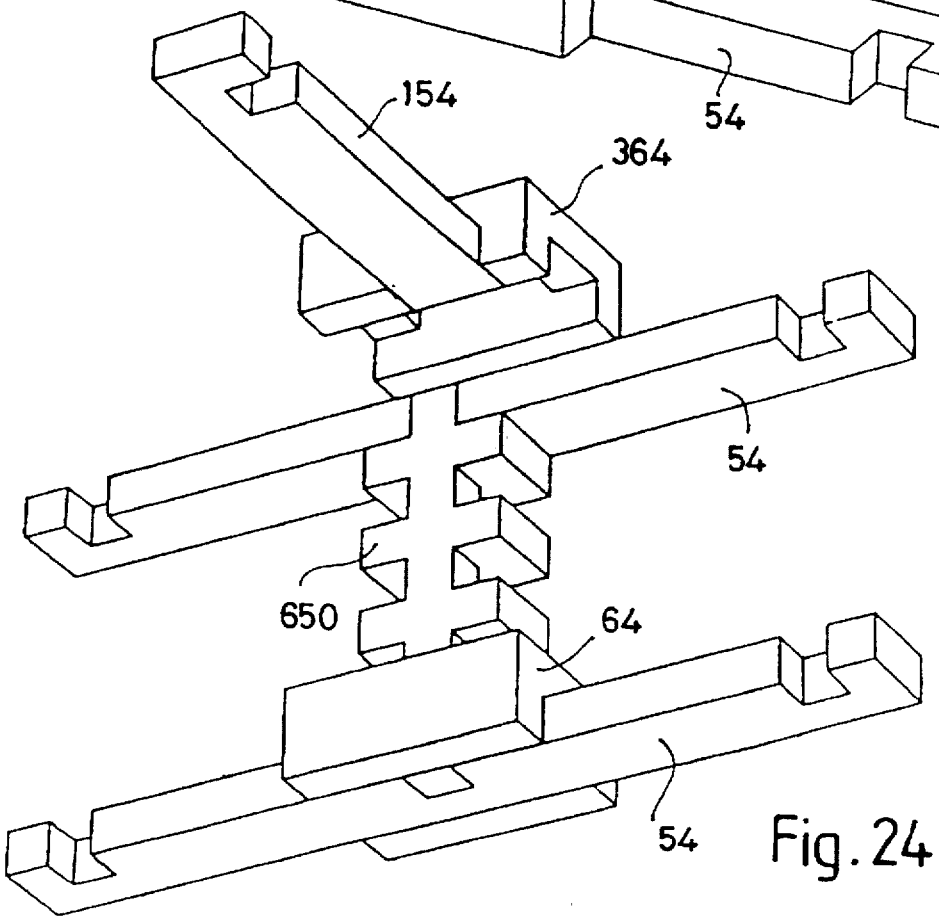

FIGS. 23 and 24 show the use of ring lock structures as shown in FIGS. 18 and 19. The manner of assembly of these structures will be apparent from the reference numerals employed which correspond to reference numerals used in earlier drawings.

Although the shoulders 52 on the vertical blocks and the edges of the recesses in the horizontal blocks are shown as being rectilinear and strictly at right angles to the axis of the respective block on which they appear, this is not an essential feature and the various edges of the blocks can be rounded or chamfered. The opposing faces of shoulders and/or recesses may be tapered to assist lead-in of joints and to facilitate manufacture of the blocks.

By use of the triangular section neck it is therefore possible for a wide variety of different building block structures to be locked in place by a rotary action of a rotary locking block.

I claim:

1. A building member having two opposite end regions connected by a neck, the neck having a cross-section which is a regular triangle with three convex sides; the sides meeting at apices which define three corners of the neck; and wherein the degree of convexity of two adjacent convex sides is such that if one corner of the neck is placed at an apex of an imaginary right angle, then the two adjacent convex sides of the triangle form tangents to lines defining that right angle.

2. A building member as claimed in claim 1, wherein the two opposite end regions provide shoulders at either end of the neck and are of rectilinear form.

3. A building system incorporating a plurality of building members as claimed in claim 1, and a plurality of building blocks the blocks having necks receiving the necks of the building members such that the blocks and the building members are locked together.

4. A building system as claimed in claim 3, including a plurality of key elements, each of the key elements comprising a wall surrounding an opening, the wall including a pair of depending shoulders which extend downwards on opposite sides of the opening by a distance greater than the downward extent of the wall sections between the shoulders.

5. A building system as claimed in claim 4, wherein the key element is rectilinear in form, with the opening being rectangular.

6. A building system as claimed in claim 5, wherein the shoulders of the key element extend along two opposite sides of the opening and wall sections which are defined between the shoulders extend along the other two sides of the opening.

7. A building system as claimed in claim 6, wherein the key element is made in two pieces.

* * * * *

UNITED STATES PATENT AND TRADEMARK OFFICE

CERTIFICATE OF CORRECTION

PATENT NO. : 5,685,120

DATED : November 11, 1997

INVENTOR(S) : Kirpal Singh Sihra

It is certified that error appears in the above-identified patent and that said Letters Patent is hereby corrected as shown below:

Title page,item [30], Foreign Application Priority Data should read--Feb. 10, 1993--.

Signed and Sealed this

Tenth Day of February, 1998

*Attest:*

Bruce Lehman

BRUCE LEHMAN

*Attesting Officer*

*Commissioner of Patents and Trademarks*